United States Patent [19]

Deason

[11] Patent Number: 4,736,525

[45] Date of Patent: Apr. 12, 1988

[54] FLOOR SQUARE

[76] Inventor: John M. Deason, Rte. 1, Box 802, Roanoke, Ala. 36274

[21] Appl. No.: 40,049

[22] Filed: Apr. 16, 1987

[51] Int. Cl.[4] ..... B43L 13/00

[52] U.S. Cl. ..... 33/474; 33/481; 33/566

[58] Field of Search ..... 33/429, 474, 476, 477, 33/479, 480, 481, 563, 566

[56] References Cited

U.S. PATENT DOCUMENTS

| | | | |
|---|---|---|---|
| 387,966 | 8/1888 | Beckwith | 33/429 |
| 2,654,153 | 10/1953 | Oyler | 33/474 |
| 2,756,505 | 7/1956 | Zaleski | 33/429 |
| 3,792,532 | 2/1974 | De Jesus | 33/474 |
| 4,654,978 | 4/1987 | Wolford, Jr. | 33/481 |

FOREIGN PATENT DOCUMENTS

| | | | |
|---|---|---|---|
| 1163437 | 3/1984 | Canada | 33/479 |

*Primary Examiner*—Richard R. Stearns
*Attorney, Agent, or Firm*—Michael C. Smith

[57] ABSTRACT

A floor square for use in squaring and marking a ledger notch in the end of a floor joist and for use in marking the intended position of a ledger on a girder.

3 Claims, 3 Drawing Sheets

FLOOR SQUARE

TECHNICAL FIELD

The present invention relates generally to a tool for use in the construction of buildings, and specifically to a floor square for use in squaring and marking a notch in the end of a floor joist to allow for placement thereof upon a ledger and for use in marking the intended position of a ledger on a girder.

BACKGROUND ART

Carpenters' squares are well known in the art. The conventional square tool is simply an L-shaped piece of flat metal having an angular juncture of 90 degrees. A square of this type is shown in U.S. Pat. No. 3,623,232. Similar squares are shown in U.S. Pat. Nos. 4,573,276 and 513,665. Other relevant marking guides and guages are shown in U.S. Pat. Nos. 3,395,456; 2,965,696; 3,010,209; and 1,732,906.

While the varieties of squares and similar devices shown in the patents referred to above are apparently well suited for their intended purposes, until the present invention there has been no specific tool for use in squaring and marking a notch in the end of a floor joist to allow for placement thereof upon a ledger and for use in marking the intended position of a ledger on a girder. It is for this reason that the present floor square was invented.

DISCLOSURE OF INVENTION

The present invention promotes quick, efficient marking of a ledger notch in the end of a floor joist, and quick, efficient marking of an intended position of a ledger on a girder. The present invention is a floor square having a horizontal straight edge for alignment of the floor square, a vertical notching member for marking an intended ledger noch in a floor joist, and a ledger alignment guide for marking the intended position of a ledger on the side of a girder.

Thus, a primary object of the present invention is to provide a tool for efficiently marking a ledger notch in the end of floor joists.

Another major object of this invention is to provide a tool for efficiently marking the intended position of a ledger on the side of a girder.

BRIEF DESCRIPTION OF THE DRAWINGS

While the specification concludes with claims particularly pointing out and distinctly claiming the subject matter which is regarded as the invention, it is believed that the invention, objects, features, and advantages, thereof will be better understood from the following description taken in connection with the accompanied drawings in which like parts are given like identification numerals and wherein:

BEST MODE FOR CARRYING OUT THE INVENTION

Figure 6:
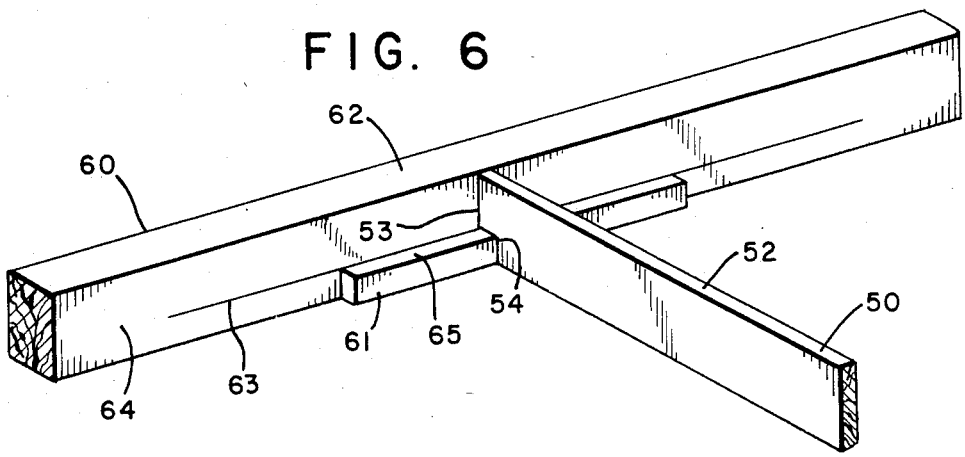
FIG. 6 is a perspective of a girder, ledger, and a floor joist as assembled according to the method described below.

While there are many ways of framing floors, the method used in connection with the present invention is often called platform framing, in which the top surfaces of the floor joists, header joists, edge joists, and girders of a floor are all in the same horizontal plane. This method is illustrated in FIG. 6-0.1 on page 120 of *Residential Carpentry* by Mortimer P. Reed, copyrighted by the publisher, John Wiley & Sons, Inc. in 1980.

For purposes of this specification, a floor joist is defined as an elongated horizontal structural member, rectangular in cross section, which has relatively narrow top and bottom surfaces and relatively wide side surfaces. A girder is defined as an elongated horizontal structural member which functions as a main beam to which ends of floor joists are secured. A ledger is defined as an elongated structual member attached to the lower side of a girder for assisting in supporting notched floor joists. A ledger notch is defined as a notch in the end of a joist for accommodating the ledger.

Figure 1:
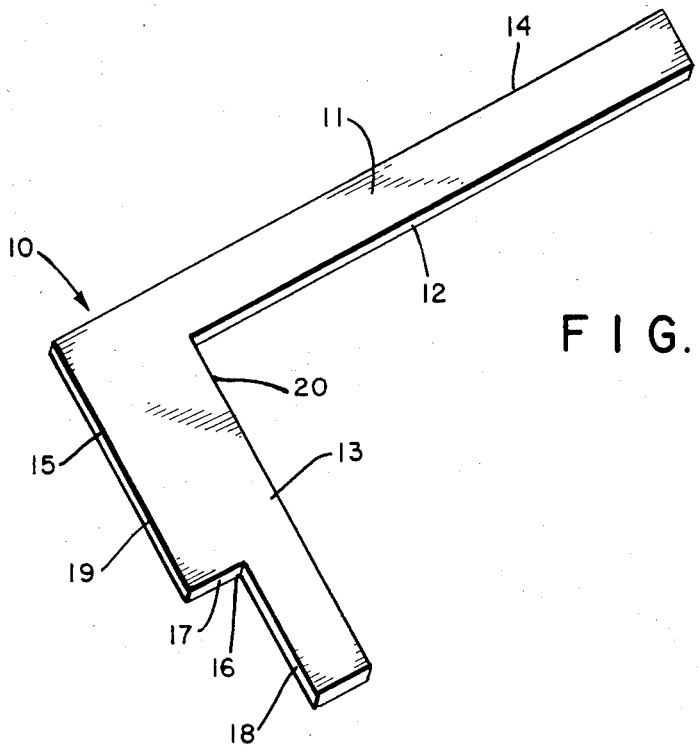
FIG. 1 is a perspective of the first preferred embodiment of the present invention.
Figure 2:
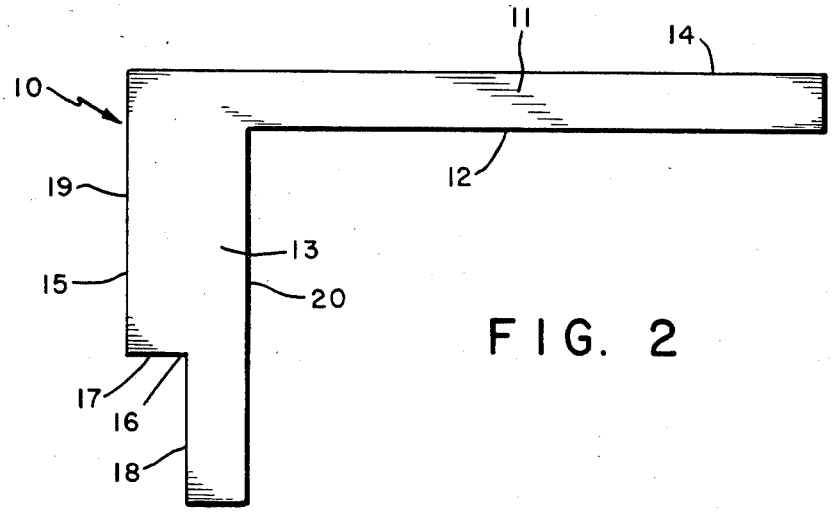
FIG. 2 is a side view of the first preferred embodiment of the present invention.

As FIG. 1 of the drawings illustrates, the preferred embodiment of the present floor square 10 is constructed of a flat, rigid material such as eleven gage steel, aluminum or other metal, plastic or similar material having substantial rigidity and durability. Horizontal straight first arm 11 is preferrably 20 inches (50.8 cm) in length from end to end. The lower edge of first arm 11 is the joist top contact surface 12. This surface 12 is preferrably 17 inches (43.18 cm) in length. The 17 inch (43.18 cm) expanse of contact surface 12 is ideal for placement on the top surface of a joist to be marked, since it is of sufficient length to cause the square 10 to be in actual square alignment by being aligned based upon a representative length of floor joist lumber rather than on a relatively short portion of the floor joist top surface. This assures that vertical member 13, disposed at 90 angular degrees from first arm 11, is actually aligned perpendicular to the top surface of the joist lumber. The preferred top to bottom height of member 11 between contact surface 12 and top edge 14 is 1.50 inches (3.81 cm) to assure rigidity and durability of first arm 11. Vertical second arm 13 has a width of 3.0 inches (7.62 cm) and an overall height of 11.0 inches (27.94 cm). Beginning $7\frac{1}{8}$ inches (18.0975 cm) from the top of second arm 13, at the left most edge 15, a square notch 16 is formed 1.50 inches (3.81 cm) wide in second arm 13, leaving a lower extension 1.50 inches (3.81 cm) wide and $3\frac{7}{8}$ inches (9.8425 cm) high, and forming a 1.50 inch (3.81 cm) horizontal guide 17 and a $3\frac{7}{8}$ inch (9.8425 cm) vertical guide 18. The most critical dimensions are the vertical distance from contact surface 12 to horizontal guide 17, $5\frac{5}{8}$ inches (14.2875 cm); and the length of horizontal guide 17, 1.50 inches (3.81 cm). These dimensions must be exact because they determine the location of each floor joist ledger notch, $5\frac{5}{8}$ inches (14.2875 cm) from the top of the joist and 1.50 inches (3.81 cm) into the end of the joist.

Figure 5:
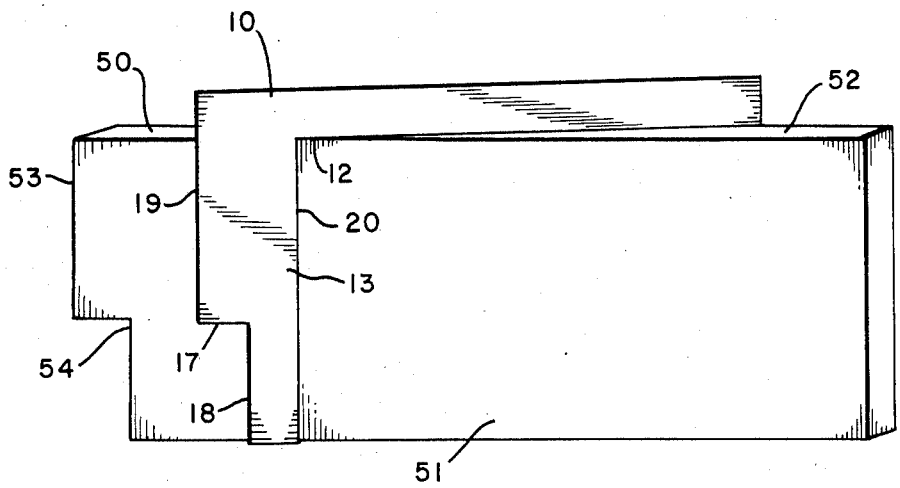
FIG. 5 is a perspective of a floor joist illustating the use of the first preferred embodiment.

Referring now to FIG. 5, it can be seen that to use this tool 10, a carpenter places contact surface 12 on the top 52 of the joist lumber 50 (a $1\frac{1}{2}$ inch (3.81 cm) by 9 inch (22.86 cm) piece of lumber), allows an inner corner 20 of vertical second arm 13 to contact the side surface 51 of the lumber, with outer edge 19 near the end 53 of the joist lumber 50. Square 10 is not parallel to the joist lumber 50 since contact surface 12 contacts joist top 52 and a inner corner 20 of vertical member 13 contacts the side 51 of joist 50. This angular alignment is only from about 5 degrees to about 10 degrees from the vertical side 51 of the lumber, and thus will not interfere with marking the lumber 50. The carpenter sights along outer edge 19 to assure a sufficiently square end 53 of the lumber. If it is not square, the carpenter scribes along outer edge 19 with a pencil or similar device to form a line perpendicular to the longitudinal axis of the lumber. He then scribes along guide 17 and guide 18 to form a ledger notch 54 into the lumber the predetermined distance from the top 52 of the joist 50 which will correspond with the distance from the top of a cooperating girder 60 to its ledger 61, as shown in FIG. 6, and the predetermined depth which will correspond to the width of the ledger 61.

Square 10 is also used to mark the predetermined location for a ledger 61 on a girder 60. To make this mark, the carpenter places contact edge 12 on top 62 of the girder 60 in an angular alignment as discussed above while placing a pencil or similar instrument in notch 16 at the juncture of guide 17 and guide 18. The square 10 and pencil are then simultaneously moved along the girder 60, resulting in a lengthwise mark 63 along the side 64 of the girder 60 a predetermined distance, $5\frac{5}{8}$ inches (14.2875 cm) from the top of the girder 60. The ledger 61, a two by four piece of lumber having dimensions of about 1.50 inches (3.81 cm) by $3\frac{1}{2}$ inches (8.89 cm), is then secured to the side 64 of the girder 60 with its top surface 65 aligned with the mark 63. The joist 50 cut by the method discussed above can then be positioned in place with the ledger notch 54 resting against the ledger 61, with the squared end 53 of joist 50 contacting the side 64 of the girder 60, and with the top 62 of the girder 60 and the top 52 of the joist 50 in the same horizontal plane. The squre 10 can be used on either side of the joist 50 or either end of the joist 50.

Figure 3:
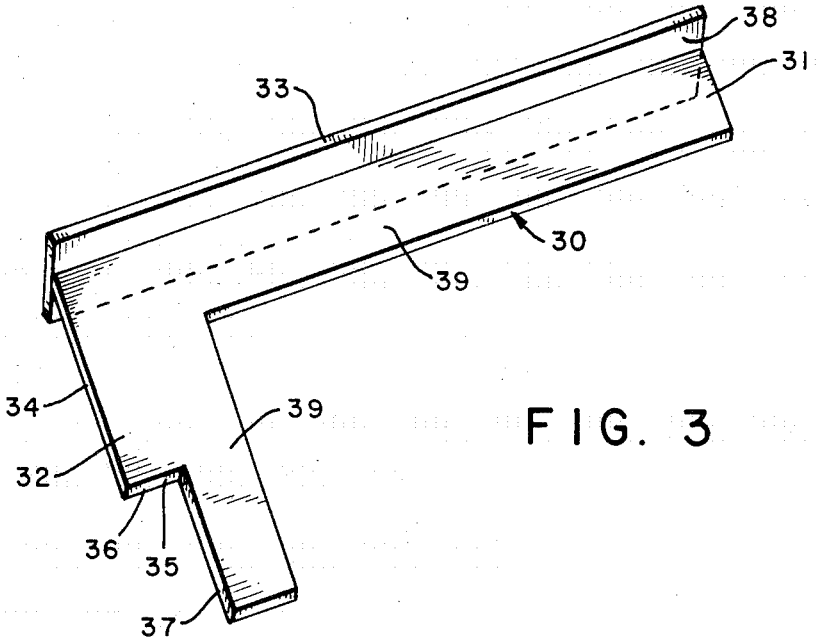
FIG. 3 is a perspective of the second preferred embodiment of the present invention.
Figure 4:
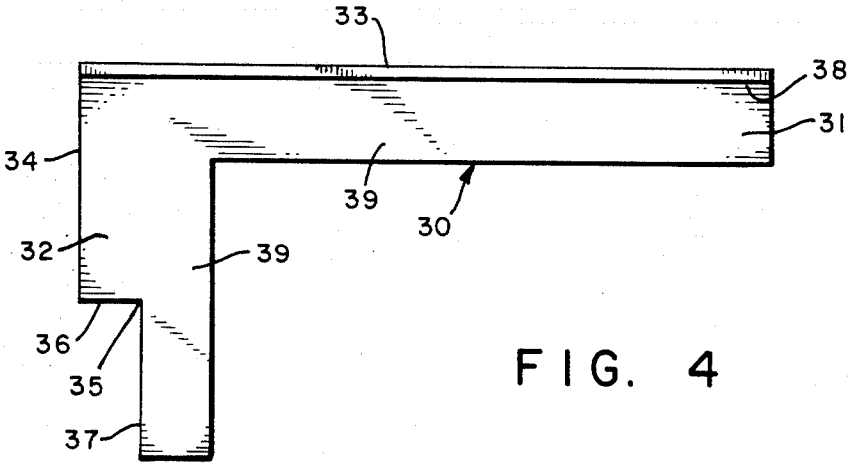
FIG. 4 is a side view of the second preferred embodiment of the present invention.

Referring now to FIG. 3, which shows a second preferred embodiment 30, it can be seen that floor square 30 comprises a horizontal straight first arm 31, a vertical second arm 32, and a top plate 33. Arms 31 and 32 are of a single flat piece of metal or similar rigid, durable material, and top plate 33 is of a similar, separate material, welded, or otherwise secured to the top of first arm 31 perpendicular thereto. The outer edge 34, square notch 35, horizontal guide 36 and vertical guide 37 of floor square 30 corresponds to the outer edge 19, square notch 16 horizontal guide 17 and vertical guide 18 of floor square 10, but contact surface 12 of square 10 is replaced by the lower surface 38 of top plate 33. Thus, the marking of a joist 50 and a girder 60 is accomplished without the angular alignment discussed above. The lower surface 38 is simply placed on top of the joist 50 or girder 60 to be marked, with the side 39 of the assembly of the vertical second arm 32 and first arm member 31 adjacent to the side 51 of the joist 50 or the side 64 of the girder 60 and the marks are made as previously described. All applicable dimensions of the floor square 10 are the same in floor square 30.

It has been determined that the easiest tool of the two (10,30) for a novice to use is the second embodiment 30, but that the most efficiently used by professional carpenter is the first embodiment 10 because it is a little lighter and easier to manuver since it is all in one plane.

While this invention has been described in detail with particular reference to a preferred embodiment therefor, it will be understood that variations and midifications can be effective within the spirit and scope of the invention as described hereinbefore and as defined in the appended claims. It is understood that the floor square as used may be used as a ceiling square, or wall square, or as a square for any other structural component which requires the markings discussed.

INDUSTRIAL APPLICABILITY

This invention is capable of exploitation in the construction tool industry and is particularly useful in industries making tools for residential framing.

I claim:

1. Apparatus for marking a squared line on a surface of lumber perpendicular to the longitudinal axis of said lumber and for marking a squared notch into the lumber from said squared line comprising:

(a) a first arm having a first bearing surface against which a longitudinal surface of said lumber is placed; and (b) a second arm, disposed perpendicular to said first arm: having a second bearing surface perpendicular to said first bearing surface against which a side surface of said lumber is placed; a squaring surface against which a pencil or similar marking tool may be scribed to mark said squared line; a first notch guide parallel to mark said squared line; a first notch guide parallel to said first bearing surface extending away from said squaring surface in a direction similar to that of said first arm, against which a pencil or similar marking tool may be scribed to mark a first side of a notch in said lumber; and a second notch guide parallel to said squaring surface and extending away from said first arm in a direction perpendicular to said first notch guide, against which a pencil or similar marking tool may be scribed to mark a second side of said notch;

further provided that said apparatus is constructed of rigid, durable material, said first notch guide is in a plane $5\frac{5}{8}$ inches (14.2875 cm) from said first bearing surface, and said first notch guide is $1\frac{1}{2}$ inches (3.81 cm) in length.

2. The apparatus of claim 1 wherein said first arm and said second arm are located in one plane.

3. The apparatus of claim 2 comprising a top plate secured perpendicular to said first arm.

* * * * *